US008320790B2

(12) United States Patent
Yamaguchi

(10) Patent No.: US 8,320,790 B2
(45) Date of Patent: Nov. 27, 2012

(54) CLEANING MEMBER, CHARGING DEVICE, TRANSFER DEVICE, ASSEMBLY, AND IMAGE FORMING APPARATUS

(75) Inventor: Mikio Yamaguchi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 277 days.

(21) Appl. No.: 12/768,422

(22) Filed: Apr. 27, 2010

(65) Prior Publication Data

US 2011/0170896 A1 Jul. 14, 2011

(30) Foreign Application Priority Data

Jan. 13, 2010 (JP) ..... 2010-005266

(51) Int. Cl.
*G03G 15/02* (2006.01)
*G03G 15/16* (2006.01)

(52) U.S. Cl. ..... 399/99; 399/100; 399/101

(58) Field of Classification Search ..... 399/99–101, 399/123, 357

See application file for complete search history.

(56) References Cited

U.S. PATENT DOCUMENTS 3,534,458 A * 10/1970 McCrea
4,870,465 A * 9/1989 Lindblad et al.
2011/0170901 A1* 7/2011 Kawai et al. ..... 399/100

FOREIGN PATENT DOCUMENTS

JP 8-137208 A 5/1996
JP 2002052369 A * 2/2002
JP 2008-070532 A 3/2008
JP 2008-304729 A 12/2008

* cited by examiner

*Primary Examiner* — David Gray
*Assistant Examiner* — Laura Roth
(74) *Attorney, Agent, or Firm* — Sughrue Mion, PLLC

(57) ABSTRACT

The cleaning member of the present invention includes a rotatably supported core; and a foam body that is disposed in a spiral shape on the core, and has at least one edge in a cross-section orthogonal to the length direction of the foam body that projects out further in the core radial direction than a central portion of the foam body.

13 Claims, 8 Drawing Sheets

CLEANING MEMBER, CHARGING DEVICE, TRANSFER DEVICE, ASSEMBLY, AND IMAGE FORMING APPARATUS

CROSS-REFERENCE TO RELATED APPLICATION

This application is based on and claims priority under 35 USC 119 from Japanese Patent Application No. 2010-005266 filed on Jan. 13, 2010.

BACKGROUND

Technical Field

The present invention relates to a cleaning member, a charging device, a transfer device, an assembly, and an image forming apparatus.

SUMMARY

The present invention enhances the cleaning capability of a cleaning member configured from a foam body disposed in a spiral shape.

A cleaning member of a first aspect of the present invention includes: a rotatably supported core; and a foam body that is disposed in a spiral shape on the core, and has at least one edge in a cross-section orthogonal to the length direction of the foam body that projects out further in the core radial direction than a central portion of the foam body.

BRIEF DESCRIPTION OF THE DRAWINGS

Exemplary embodiments of the present invention will be described in detail based on the following figures, wherein.

DETAILED DESCRIPTION

Figure 1:
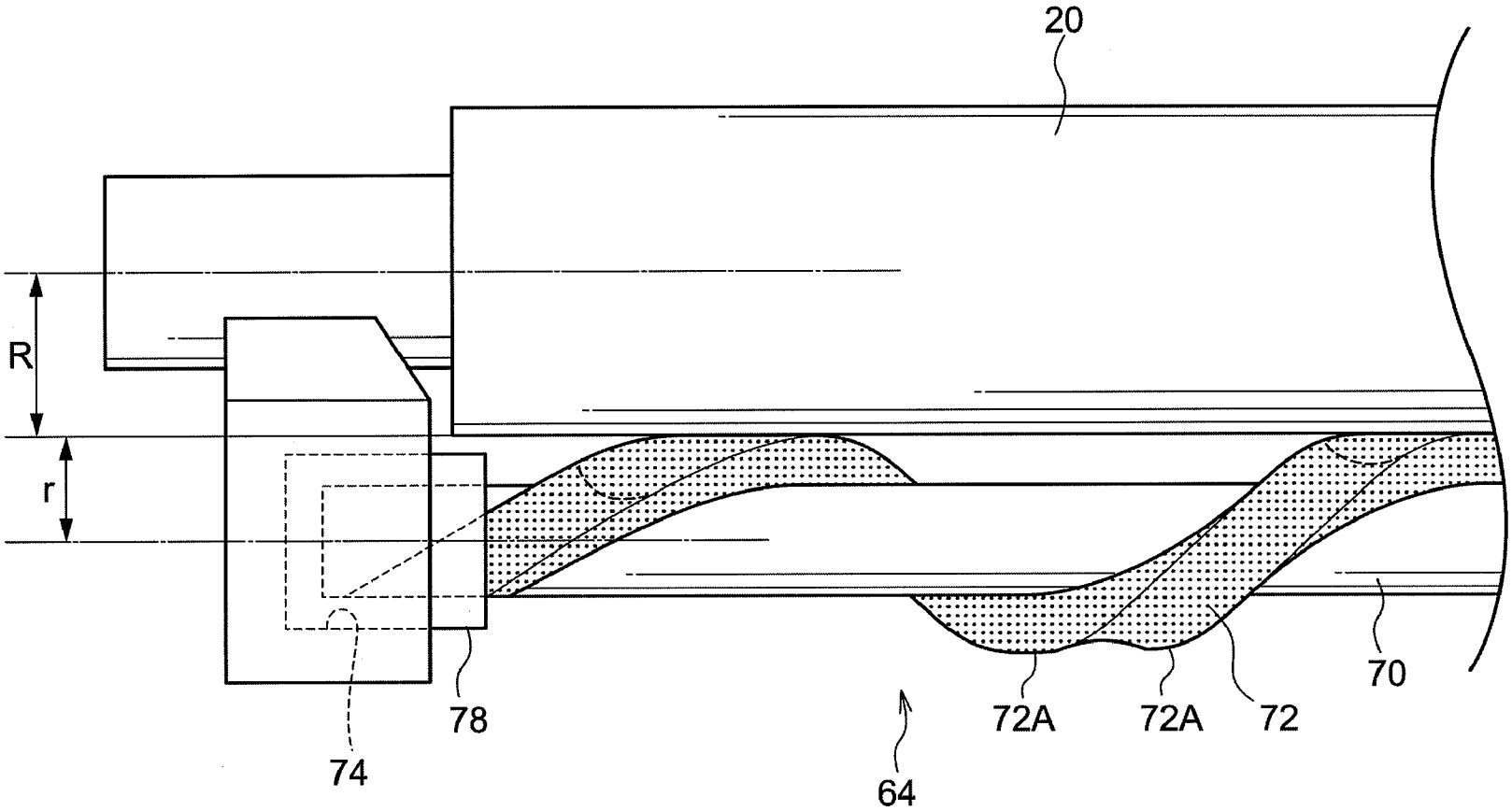
FIG. 1 is a front face view showing a cleaning member, and the like, according to a first exemplary embodiment of the present exemplary embodiment.

Explanation follows of examples of a cleaning member, a charging device, assembly, and image forming apparatus, according to a first exemplary embodiment, with reference to FIG. 1 to FIG. 6. The arrow UP shown in the drawings indicates the vertical top direction.

(Overall Configuration)

Figure 6:
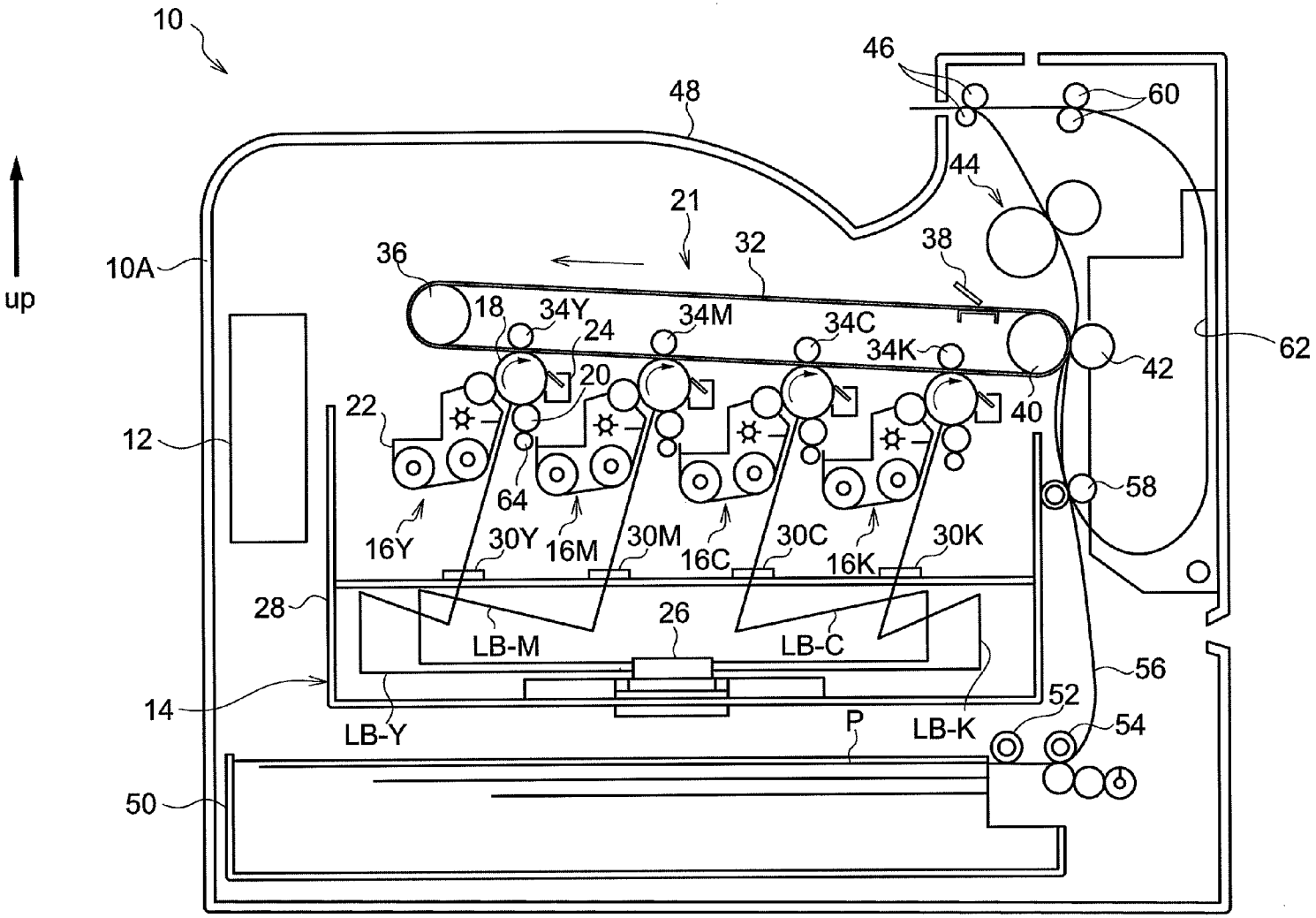
FIG. 6 is a schematic configuration diagram showing an image forming apparatus according to the first exemplary embodiment.

As shown in FIG. 6, an image processing section 12 for performing image processing to input image data is provided within a main body 10A of an image forming apparatus 10.

The image processing section 12 performs processing on input image data to process into gradation data of four colors, yellow (Y), magenta (M), cyan (C) and black (K). An exposure device 14 is provided at a central location within the main body 10A, and receives this processed gradation data and performs image exposure using laser beams LB.

Four image forming units 16Y, 16M, 16C and 16K, of yellow (Y), magenta (M), cyan (C) and black (K), respectively, are disposed above the exposure device 14, at intervals along the horizontal direction. Note that sometimes Y, M, C, and B are omitted when there is no need to discriminate between Y, M, C, and B.

The four image forming units 16Y, 16M, 16C and 16K are each of a similar configuration, configured including: a circular cylindrical shaped image holding body 18 that is rotationally driven at a predetermined velocity; a charging member 20, for primary charging, that charges the outer peripheral face of the image holding body 18; a developing member 22 that develops an electrostatic latent image, formed on the outer peripheral face of the charged image holding body 18 by image forming light exposure of the exposure device 14, described below, with toner of a predetermined color, making the electrostatic latent image visible as a toner image; and a cleaning blade 24 that cleans the outer peripheral face of the image holding body 18. A cleaning member 64 is provided below the charging member 20, making contact with the circular cylindrical shaped charging member 20 and cleaning the outer peripheral face of the charging member 20.

A charging device is configured, as an example of a cleaned member configuring the image forming unit 16, by the charging member 20 and the cleaning member 64. A replacement cartridge 66 (see FIG. 2) is configured, as example of an assembly, by the image holding body 18, the charging member 20 and the cleaning member 64. The replacement cartridges 66 are each replaceable in the main body 10A. Details regarding the cleaning member 64 are described below.

In the exposure device 14, there are four semiconductor lasers, not shown in the figures, provided in a common configuration to the four image forming units 16Y, 16M, 16C and 16K. Laser beams LB-Y, LB-M, LB-C, and LB-K are emitted from the semiconductor lasers according to the gradation data.

Note these laser beams LB-Y, LB-M, LB-C, and LB-K emitted from the semiconductor lasers are irradiated onto a polygon mirror 26, this being rotatable multi-faceted mirror, through a f-θ lens, not shown in the figures, so as to be deflection-scanned by the polygon mirror 26. The laser beams LB-Y, LB-M, LB-C, and LB-K that have been deflection-scanned by the polygon mirror 26 pass through a focusing lens and via plural mirrors, so as to undertake scanning light exposure at a light exposure point on the image holding body 18, diagonally from below.

Since the exposure device 14 performs scanning light exposure of an image on the image holding body 18 from below, there might be concern in the exposure device 14 about, for example, toner or the like, falling from the developing member 22 of the four image forming units 16Y, 16M, 16C and 16K positioned above. The periphery of the exposure device 14 is therefore closely sealed by a rectangular shaped frame 28. Windows 30Y, 30M, 30C and 30K made from transparent glass are provided at the top of the frame 28, to let the four laser beams LB-Y, LB-M, LB-C, and LB-K pass through towards the image holding bodies 18 of each of the image forming units 16Y, 16M, 16C and 16K above.

A primary transfer unit 21 is provided above the image forming units 16Y, 16M, 16C and 16K. The primary transfer unit 21 is configured including: an endless shaped intermediate transfer belt 32; a drive roll 40, around which the intermediate transfer belt 32 is entrained and that rotationally drives the intermediate transfer belt 32 in the direction of the arrow; a tensioning roll 36, around which the intermediate transfer belt 32 is entrained and that imparts tension to the intermediate transfer belt 32; a cleaning blade 38 that cleans the outer peripheral face of the intermediate transfer belt 32; and primary transfer rolls 34Y, 34M, 34C and 34K that are disposed at the opposite side of the intermediate transfer belt 32 to the side of the image holding bodies 18Y, 18M, 18C and 18K, with the intermediate transfer belt 32 interposed therebetween.

Configuration is made such that the toner images of each of the colors, yellow (Y), magenta (M), cyan (C) and black (K), that have been formed in sequence on the image holding bodies 18 of the image forming units 16Y, 16M, 16C and 16K, are transferred and superimposed onto the intermediate transfer belt 32 by the four primary transfer rolls 34Y, 34M, 34C and 34K.

A secondary transfer roll 42 is provided on the opposite side of the intermediate transfer belt 32 to that of the drive roll 40, with the intermediate transfer belt 32 interposed therebetween. The toner images, of each of the colors, yellow (Y), magenta (M), cyan (C) and black (K) that have been transferred and superimposed onto the intermediate transfer belt 32, are conveyed by the intermediate transfer belt 32, nipped between the drive roll 40 and the secondary transfer roll 42, so as to be secondary transferred to a sheet member P, serving as a recording medium, that is being conveyed along a paper conveying path 56.

A fixing device 44 is further provided at the sheet member P conveying direction downstream side (referred to below simply as the downstream side) relative to the secondary transfer roll 42, and the fixing device 44 applies heat and pressure to the toner image transferred onto the sheet member P, thereby fixing the toner image to the sheet member P.

Discharge rolls 46 are also provided at the downstream side of the fixing device 44, for discharging sheet member P fixed with the toner image into a discharge section 48 provided at the top of the main body 10A of the image forming apparatus 10.

A paper feed section 50 stacked with sheet members P is provided at the bottom side in the main body 10A of the image forming apparatus 10. A paper feed roll 52 is also provided for feeding out sheet members P stacked in the paper feed section 50 along the paper conveying path 56. A separator roll 54 is provided at the downstream side of the paper feed roll 52, for separating and conveying the sheet members P one sheet at a time. A positioning roll 58 is provided at the downstream side of the separator roll 54, for matching conveying timing. Configuration is thereby made such that the sheet members P fed out from the paper feed section 50, are conveyed at predetermined timings by rotation of the positioning roll 58 towards the position of contact of the intermediate transfer belt 32 and the secondary transfer roll 42 (secondary transfer position).

Furthermore, adjacent to the discharge rolls 46, conveying rolls 60 are provided, for conveying sheet members P, to which an image has been fixed on one side by the fixing device 44 onto a double-sided conveying path 62, without them being discharged in this state onto the discharge section 48 by the discharge rolls 46. The sheet members P conveyed in this manner along the double-sided conveying path 62, are re-conveyed to the positioning roll 58 in a front-back reversed state, such that this time a toner image is transferred and fixed to the back face of the sheet member P, with the sheet member P then being discharged into the discharge section 48.

Images are formed on the sheet member P in the following manner with the above configuration.

First gradation data for each of the colors is output in sequence from the image processing section 12 to the exposure device 14, laser beams LB-Y, LB-M, LB-C, and LB-K emitted from the exposure device 14 according to the gradation data are exposed onto the outer peripheral face of the image holding bodies 18 that have been charged by the charging members 20 so that the electrostatic latent images is formed on the image holding bodies 18. The electrostatic latent images formed on the image holding bodies 18 are made visible as toner images of each of the respective colors, yellow (Y), magenta (M), cyan (C) and black (K), by the developing members 22Y, 22M, 22C and 22K.

The toner images of each of the colors yellow (Y), magenta (M), cyan (C) and black (K) formed on the image holding bodies 18 are transferred and superimposed onto the circulating intermediate transfer belt 32 by the primary transfer rolls 34 of the primary transfer units 21 disposed so as to span across above each of the image forming units 16Y, 16M, 16C and 16K.

The toner images of each of the colors that have been transferred and superimposed onto the circulating intermediate transfer belt 32 are then secondarily transferred by the secondary transfer roll 42 onto the sheet members P conveyed with predetermined timing along the paper conveying path 56, from the paper feed section 50, by the paper feed roll 52, the separator roll 54, and the positioning roll 58.

Furthermore, the sheet member P to which the toner image has been transferred is conveyed towards the fixing device 44. The toner image transferred onto the sheet member P is fixed to the sheet member P by the fixing device 44, and then, after fixing, the sheet member P is discharged by the discharge rolls 46 into the discharge section 48 provided at the top of the main body 10A of the image forming apparatus 10.

Furthermore, when images are to be formed on both sides of the sheet member P, the conveying direction of the sheet member P, to which an image has been fixed on one face by the fixing device 44, is switched, without being discharged in the current state into the discharge section 48 by the discharge rolls 46, and the sheet member P is conveyed along the double-sided conveying path 62 via the conveying rolls 60. By conveying the sheet member P along the double-sided conveying path 62, the sheet member P is conveyed to the positioning roll 58 with the front and back faces of the sheet member P are reversed. This time, a toner image is transferred and fixed to the back face of the sheet member P, and then, after transferring and fixing, the sheet member P is discharged into the discharge section 48 by the discharge rolls 46.

(Relevant Portions of the Configuration)

Explanation follows regarding the cleaning member 64 for cleaning the outer peripheral face of the circular cylindrical shaped charging member 20.

Figure 2:
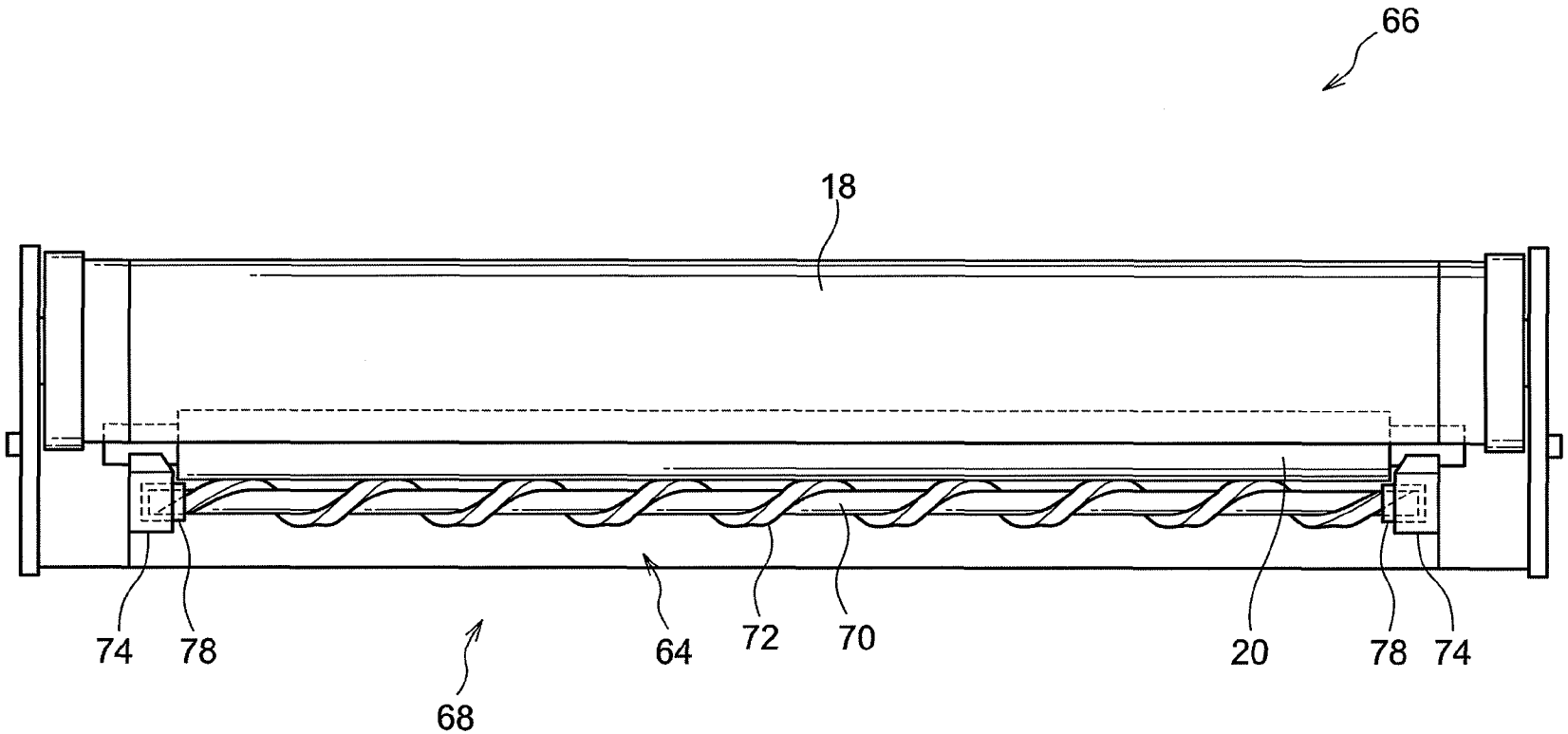
FIG. 2 is a front face view showing a cleaning member, a charging device, and a replacement cartridge according to the first exemplary embodiment of the present exemplary embodiment.

As shown in FIG. 1 and FIG. 2, the cleaning member 64 is provided facing the charging member 20 and extending along the axial direction of the charging member 20 (referred to below simply as the axial direction). The cleaning member 64 is equipped with a circular cylindrical shaped core member 70 extending along the axial direction, and a foam body 72 disposed on the core member 70 in a spiral shape. In the present invention, as an example, the foam body 72 is formed by a foam body of a resiliently deformable urethane resin, and fixed to the outer peripheral face of the core member 70 using double-sided tape (not shown in the figures).

Figure 4:
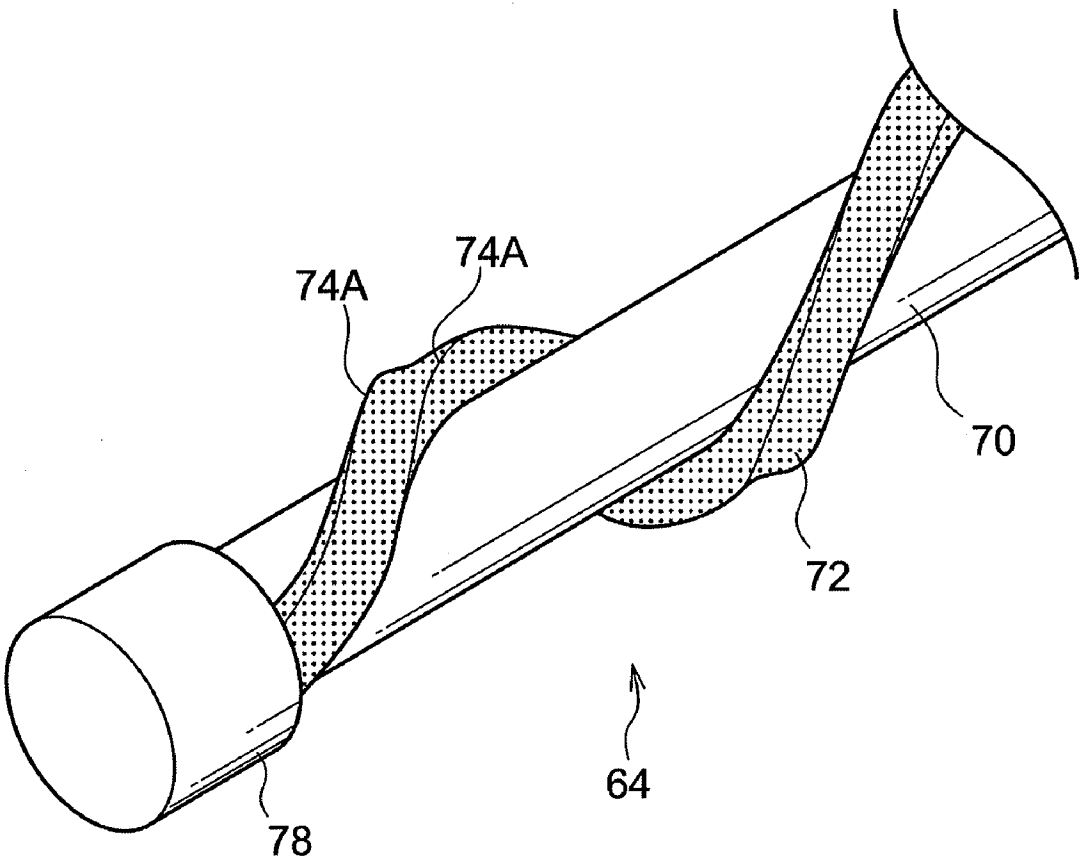
FIG. 4 is a perspective view showing a cleaning member according to the first exemplary embodiment.

Furthermore, as shown in FIG. 1 and FIG. 4, cylindrical shaped retaining members 78 are provided at both end sections of the foam body 72, nipping the end sections of the foam body 72 between the retaining members 78 and the core member 70, and preventing separation of the end sections of the foam body 72 from the core member 70.

Furthermore, both end sections of the cleaning member 64 are rotatably supported from the outside of the retaining members 78 by shaft bearing members 74 provided at the two end sections of the cleaning member 64. The shaft bearing members 74 support the cleaning member 64 in a state in which the foam body 72 is compressed against the outer peripheral face of the charging member 20 by a predetermined amount. According to this configuration, frictional force is generated between the foam body 72 and the charging member 20, such that the cleaning member 64 rotates due to rotation force from the charging member 20.

The radius of the charging member 20 and the radius of the cleaning member 64 are determined such that when the cleaning member 64 rotates due to the rotation force from the charging member 20, the contact position of the foam body 72 and the outer peripheral face of the charging member 20 changes every rotation.

Specifically, if the radius of the charging member 20 shown in FIG. 1 is denoted radius R, and the sum of the radius of the cleaning member 64 and the thickness of the foam body 72 is denoted radius r (the radius when the foam body 72 is in a compressed state against the charging member 20), then radius R is determined so as not to be an integer multiple of radius r. In other words, the relationship between radius R and radius r is determined so as to satisfy the following formula.

$$R \neq kr \text{ (wherein k is an integer)}$$

By so doing, the position of contact of the foam body 72 with the outer peripheral face of the charging member 20 changes.

Figure 3:
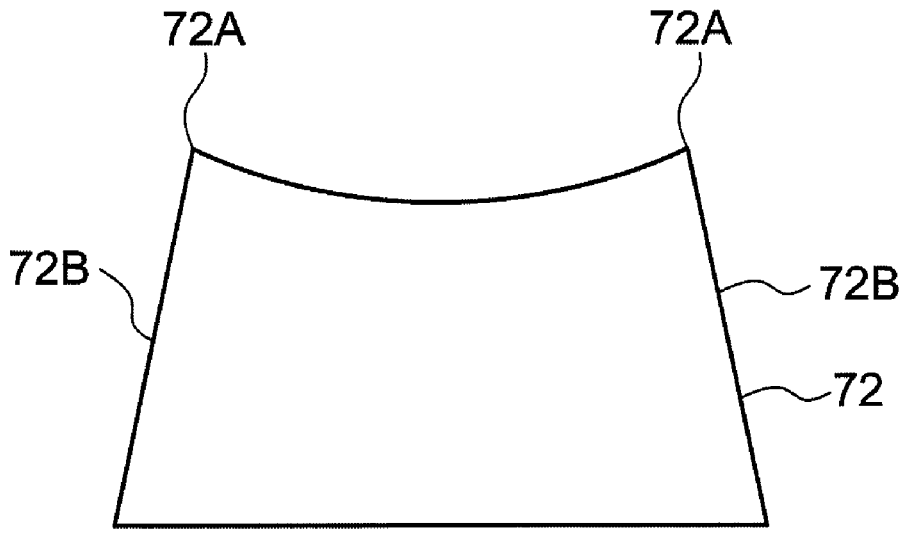
FIG. 3 is a cross-section showing a foam body according to the first exemplary embodiment.

As shown in FIG. 1 and FIG. 3, in a cross-section of the foam body 72 taken orthogonally to its length direction in a free state with no external force acting thereon, both edges 72A of the foam body 72 project out further, in the radial direction of the core member 70 (referred to below simply as the radial direction), than the central portion of the foam body 72, such that both sides 72B is sloped inward and the edges 72A get closer together in a cross-section orthogonal to the length direction.

(Operation)

As shown in FIG. 6, the toner images formed on the outer peripheral faces of the rotating image holding bodies 18 are transferred to the circulating intermediate transfer belt 32. Furthermore, any foreign matter, such as toner or the like, not transferred to the intermediate transfer belt 32 and remaining on the outer peripheral faces of the image holding bodies 18, is removed from the outer peripheral face of the image holding bodies 18 by the cleaning blades 24.

Foreign matter, contained in the developer of small particle size, such as an external additive or the like, pass through under the cleaning blade 24. The foreign matter that has passed through under the cleaning blade 24, such as an external additive or the like, adheres to the outer peripheral face of the charging member 20.

Figure 5A:
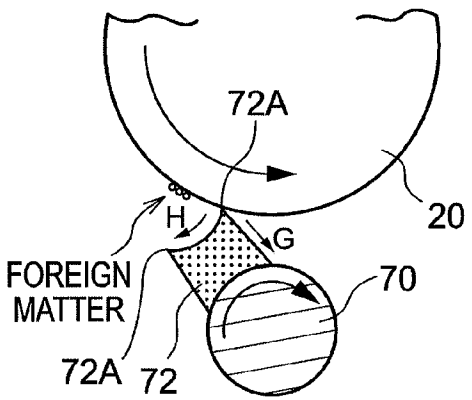
FIG. 5A is a side view showing a cleaning member according to the first exemplary embodiment.
Figure 5B:
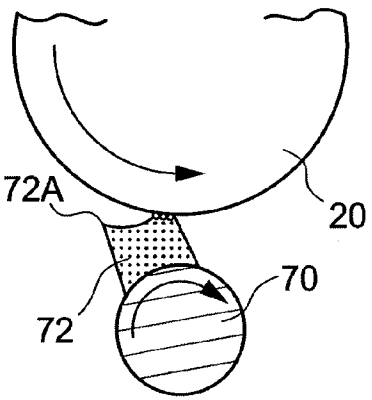
FIG. 5B is a side view showing a cleaning member according to the first exemplary embodiment.
Figure 5C:
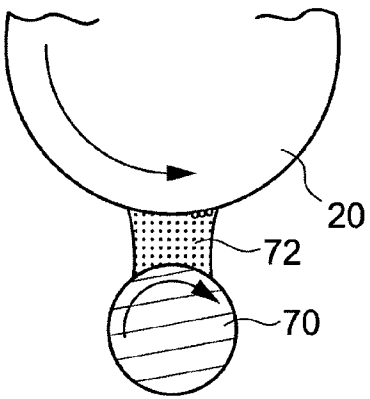
FIG. 5C is a side view showing a cleaning member according to the first exemplary embodiment.
Figure 5D:
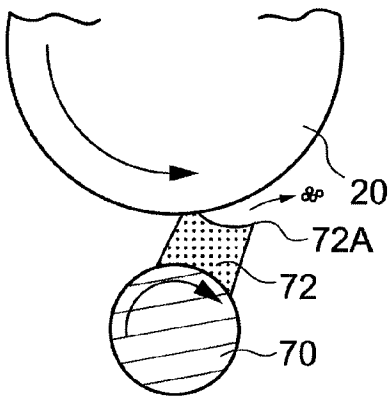
FIG. 5D is a side view showing a cleaning member according to the first exemplary embodiment.

As shown in FIG. 5A to FIG. 5C, the edges 72A of the foam body 72, in the cleaning member 64 rotating due to rotational force from the charging member 20, are pressed by the outer peripheral face of the charging member 20 so that the edges 72A of the foam body 72 are resiliently deformed in the height direction of the foam body 72 (direction G shown in FIG. 5A) and in the width direction (direction H shown in FIG. 5A). The foreign matter adhered to the outer peripheral face of the charging member 20 rotating in the direction shown by the arrow, such as an external additive or the like, is pressed and aggregated by the foam body 72. Then, as shown in FIG. 5D, the resilient deformation to the edges 72A of the foam body 72, in the cleaning member 64 rotating due to rotational force from the charging member 20, reverts to the original shape due to contact with the charging member 20 being released, and the aggregated foreign matter, such as an external additive or the like, is released from the closely pressed state, and thrown off from the outer peripheral face of the charging member 20.

Note that, in the drawings of FIG. 5A to FIG. 5D, in order to facilitate understanding of the radial direction deformation of the foam body 72, the dimensions are drawn exaggerated in the radial direction of the foam body 72.

As explained above, by making the shape of the foam body 72 such that the edges 72A project out further than the central portion thereof, and causing resilient deformation (resilient compression) of the edges 72A in both the height direction of the foam body 72 and the width direction of the foam body 72, the restoration force of the edges 72A is more effectively utilized in comparison to when resilient deformation is only made in the height direction, and foreign matter adhered to the charging member 20 is thrown off (removed) from the outer peripheral face of the charging member 20. The cleaning capability of the cleaning member 64 is thereby enhanced. Due to the foam body 72 being disposed on the core member 70 in a spiral shape, a component of force in the axial direction also acts on the foreign matter adhered to the charging member 20 due to restoration of the deformation in the width direction.

A portion of the removed foreign matter remains within the foam body 72, and a portion thereof falls from the cleaning member 64 in the direction of gravity and is trapped in a foreign matter trap (not shown in the figures). Furthermore, foreign matter remaining present on the surface of the charging member 20 released from the closely pressed state, sometimes moves across to the image holding body 18 and is recovered by an image holding body cleaning device (not shown in the figures).

Furthermore, the radius of the charging member 20 and the radius of the cleaning member 64 are determined such that the position of contact of the foam body 72 with the outer peripheral face of the charging member 20 changes when the cleaning member 64 is rotating due to rotational force from the charging member 20. Therefore, the foreign matter, such as an external additive or the like, is thrown off (removed) from the outer peripheral face of the charging member 20 without unevenness.

Furthermore, due to the cleaning member 64 evenly throwing off (removing) the foreign matter, such as an external additive or the like, adhered to the outer peripheral face of the charging member 20, defective charging of the image holding body 18 is suppressed. Consequently, the quality of the toner image formed on the image holding body 18 is enhanced.

Furthermore, by enhancing the quality of the toner image formed on the image holding body 18, the output image quality formed on the sheet member P is also enhanced.

Note that while detailed explanation has been given regarding a particular exemplary embodiment of the present invention, the exemplary embodiments of the present invention are not limited thereto, and it is clear to a person of ordinary skill in the art that various other exemplary embodiments are possible within the scope of the present invention. For example, in the above exemplary embodiment, both of the edges 72A of the foam body 72 projected out further than the central portion thereof, however there is no particular limitation thereto, and configuration may be made with only one of the edges 72A projecting out. Note that in cases of one edge only, projecting out the edge of the foam body that first makes contact with the charging member, when the cleaning member is undertaking following rotation, effectively throws off (removes) the foreign matter, such as an external additive or the like, from the charging member.

Furthermore, in the above exemplary embodiment, a foam body of resiliently deformable urethane resin is employed as material for the foam body 72, however there is no particular limitation thereto, and other materials, such as, for example, foam bodies of rubber materials or the like, may be employed.

Furthermore, in the above exemplary embodiment, the replacement cartridge 66 is configured with the image holding body 18, the charging member 20 and the cleaning member 64, however other members, such as, for example, a developing member, may be added as configuration components of the replacement cartridge 66.

Figure 7A:
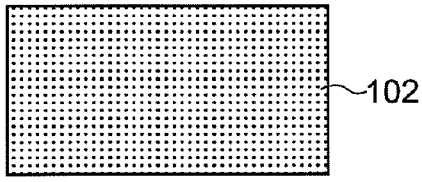
FIG. 7A is a cross-section showing a foam body according to a second exemplary embodiment.
Figure 7B:
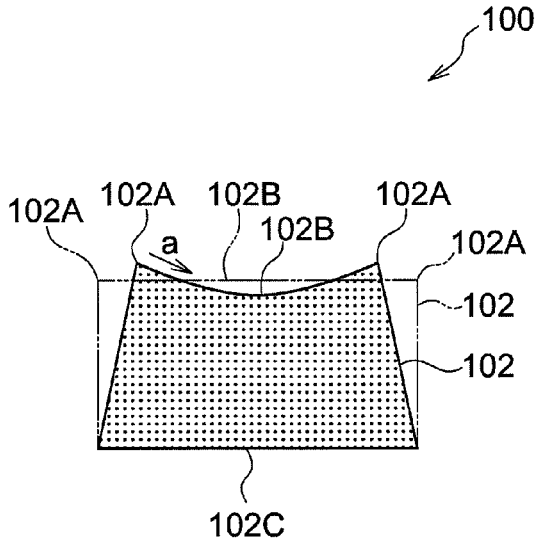
FIG. 7B is a cross-section showing a foam body according to the second exemplary embodiment.

Explanation follows of an example of a cleaning member according to a second exemplary embodiment of the present invention, with reference to FIGS. 7A and 7B. Note that similar parts to those of the first exemplary embodiment are allocated the same reference numerals and explanation thereof is omitted.

As shown in FIG. 7A, a foam body 102, wound on and attached in a spiral shape to a core (not shown in the figures) of a cleaning member 100 of the second exemplary embodiment, has a rectangular shape, in a cross-section taken orthogonally to the length direction of the foam body 102, when the foam body 102 is in a free state prior to being wound on and attached to the core.

The foam body 102 is then wound on and attached to the core in a spiral shape, and when a bottom portion 102C of the foam body 102 is fixed to the outer peripheral face of the core, due to the separation distance from the core axial center to the bottom portion 102C and to a central portion 102B being different, the central portion 102B adopts a tensioned shape along the length direction. In the present exemplary embodiment, by optimizing, for example, the radius of the core, the thickness, rigidity, and the like, of the foam body 102, the cross-section of the foam body 102 after being wound on and attached to the core adopts a state with the following configuration.

Namely, as shown by the solid lines in FIG. 7B, in the state in which the foam body 102 is wound on and attached to the core in a spiral shape, both edges 102A of the foam body 102 in a cross-section orthogonal to the length direction project out further than both of the edges 102A of the foam body 102 prior to being wound on and attached to the core (as shown by the double-dot broken lines in FIG. 7B). Furthermore, in the state in which the foam body 102 is wound on and attached to the core in a spiral shape, the central portion 102B of the foam body 102 in a cross-section orthogonal to the length direction, is indented further than the central portion 102B of the foam body 102 prior to being wound on and attached to the core.

Note that the amount of projection of the edges 102A, the amount of indentation of the central portion 102B, and the separation distance between the edges 102A, and the like, can be adjusted by winding and attaching the foam body 102 to the core in a state in which an appropriate amount of tension is imparted to the foam body 102 in the length direction of the foam body 102.

In the present exemplary embodiment, a core of Φ4 mm is employed, and urethane foam with a thickness and a width when in the free state of 2.5 mm and 6 mm, respectively, is wound on and attached to the axial center of the core at an angle of 25°, with the bottom portion 102C attached to the core with double-sided tape, so as to achieve a configuration with the height of the edges 102A being about 3 mm, and the height of the central portion 102B being about 2 mm.

As explained above, by making both the edges 102A of the foam body 102 project out further in the radial direction than when in the free state, and by indenting the central portion 102B further than when in the free state, internal stress is induced by deformation, and when the compressed state is released after the edges 102A have been compressed, the restoration force becomes stronger. Therefore, when the cleaning member 100 rotates due to rotational force from the charging member 20, foreign matter, such as an external additive or the like, adhered to the outer peripheral face of the charging member 20 is released from the closely pressed state, and thrown off from the outer peripheral face of the charging member 20 due to this stronger restoration force.

The following mechanism is hypothesized to occur. In the state of FIG. 7B, there is stress acting at the edges 102A of the foam body 102, wound on and attached to the core, in the direction a towards the central portion 102B. When the cleaning member 100 rotates due to rotational force from the charging member 20, deformation (stretching) occurs in the opposite direction to direction a, due to the edges 102A of the foam body 102 making contact with, and being pressed by, the outer peripheral face of the charging member 20. When the edges 102A are released from contact with the charging member 20 they rapidly restore in direction a. It is thought that due to this restoration force, the aggregated foreign matter, such as an external additive or the like, is released from the closely pressed state, and thrown off from the outer peripheral face of the charging member 20, enabling more effective cleaning to be accomplished than when there is no internal stress present.

Due to the foam body 102 being disposed in a spiral shape on the core, a component of force in the axial direction acts on the foreign matter adhered to the charging member 20 due to restoration of the deformation.

While in the above exemplary embodiment both of the edges 102A in a cross-section of the foam body 102 project out further in the radial direction than the central portion 102B, configuration may be made with only one of the edges 102A projecting out further.

Note that in cases of one edge only, projecting out the edge of the foam body that first makes contact with the charging member, when the cleaning member is undertaking following rotation, effectively throws off (removes) the foreign matter, such as an external additive or the like, from the charging member. Making only one of the edges 102A project out in the radial direction can be accomplished by, for example, adjusting the range over which the foam body 102 is adhered to the core, the portion imparted with tension, the direction of tension, and the like.

Furthermore, in the above exemplary embodiment, a foam body of a resiliently deformable urethane resin is employed, namely urethane foam is employed as the material for the foam body 102, however there is no particular limitation thereto, and other materials may be employed. However, in consideration of the need to deform by internal stress to project the edges 102A out, a relatively soft material is preferable, and in the case of urethane foam the edges are readily made to project out.

Figure 8:
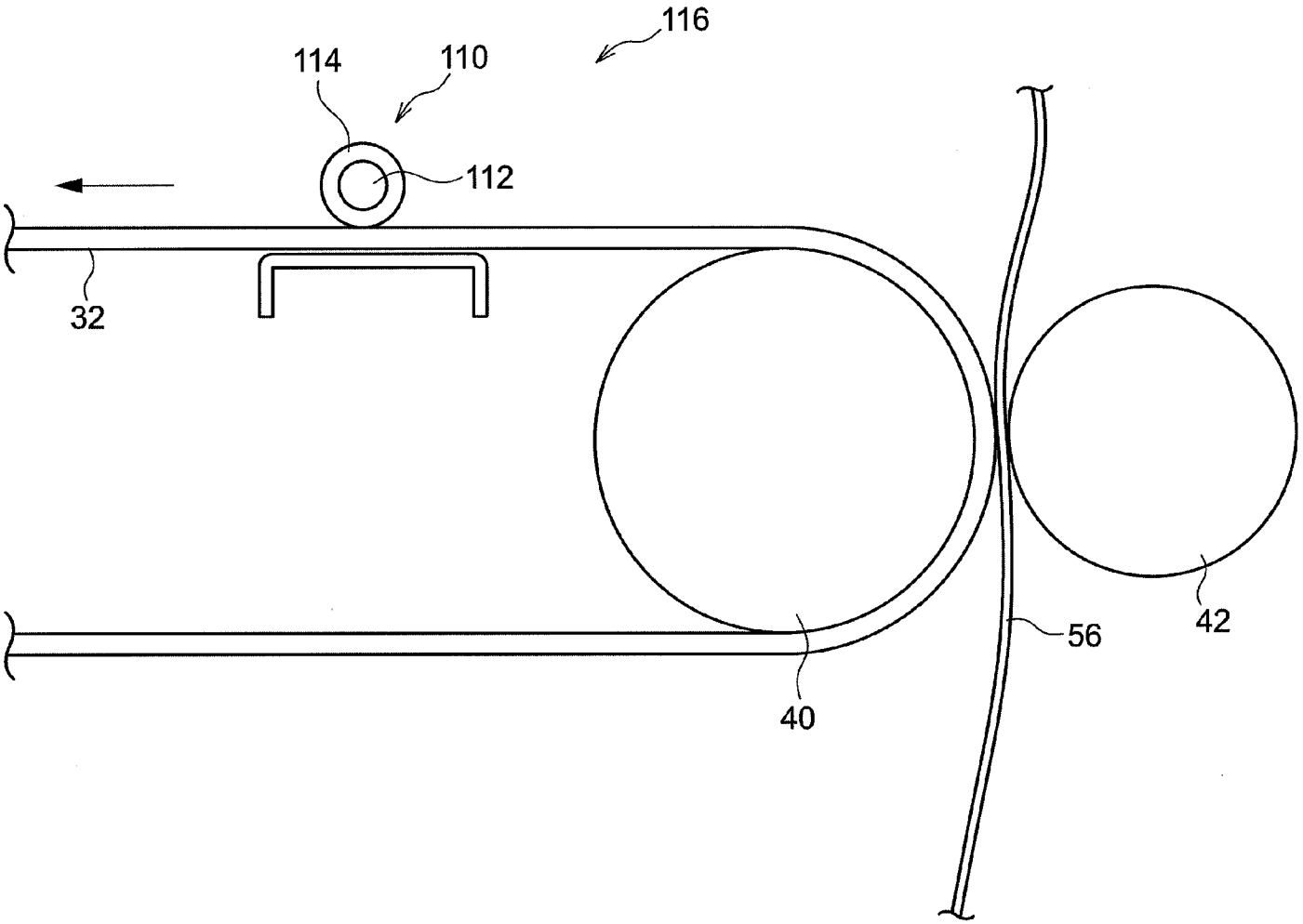
FIG. 8 is a cross-section showing a cleaning member, and the like, according to a third exemplary embodiment.

Explanation follows of an example of a cleaning member according to a third exemplary embodiment of the present invention, with reference to FIG. 8. Similar parts to those of the first exemplary embodiment are allocated the same reference numerals and explanation thereof is omitted.

As shown in FIG. 8, a foam body 114 wound and attached in a spiral shape to the outer peripheral face of a core 112 of a cleaning member 110 of the third exemplary embodiment is provided in place of, or in addition to, the cleaning blade 38, such that the cleaning member 110 rotates due to the circulating force from the intermediate transfer belt 32. A transfer device 116 is configured by the cleaning member 110 and the intermediate transfer belt 32.

Foreign matter, such as toner, external additives, or the like, adhered to the outer peripheral face of the intermediate transfer belt 32 is thereby thrown off (removed) from the outer peripheral face of the intermediate transfer belt 32.

Note that while detailed explanation has been given regarding a particular exemplary embodiment of the present invention, the exemplary embodiments of the present invention are not limited thereto, and it is clear to a person of ordinary skill in the art that various other exemplary embodiments are possible within the scope of the present invention. For example, in the above exemplary embodiment, the cleaning member 110 is employed in the cleaning of the intermediate transfer belt 32, however, there is no particular limitation to the intermediate transfer belt 32, and the cleaning member may be employed for cleaning an intermediate transfer roll, a transfer belt, a transfer roll, an image holding body, or the like.

What is claimed is:

1. A cleaning member comprising:

a rotatably supported core; and a foam body that is disposed in a spiral shape on the core, and has a cross-section orthogonal to a length direction of the foam body, wherein at least one side portion of an edge of the cross-section that is farthest from the rotatably supported core in a radial direction projects out further in the radial direction than a central portion of the edge of the cross-section that is farthest from the rotatably supported core.

2. The cleaning member of claim 1, wherein, in a state in which the foam body is disposed in the spiral shape on the core, both edges in the cross-section orthogonal to the length direction of the foam body project out further in the core radial direction than the central portion of the foam body.

3. The cleaning member of claim 1, wherein, in a state in which the foam body is disposed in the spiral shape on the core, stress acts towards the central portion on the at least one edge of the foam body in the cross-section orthogonal to the length direction of the foam body.

4. A cleaning member comprising:

a rotatably supported core; and a foam body that is disposed in a spiral shape on the core, and has at least one edge in a cross-section orthogonal to a length direction of the foam body that projects out further in a core radial direction than a central portion of the foam body, wherein:

the cross-section orthogonal to the length direction of the foam body is a rectangular shape; and in a state in which the foam body is wound on and attached to the core in the spiral shape, the at least one edge, in the cross-section orthogonal to the length direction of the foam body, projects out further than the at least one edge of the foam body projected out prior to being wound on and attached to the core, and the central portion, in the cross-section orthogonal to the length direction of the foam body, is indented further than the central portion prior to being wound on and attached to the core.

5. The cleaning member of claim 1, wherein the foam body is wound on and attached to the core in a state in which tension is imparted to the foam body in the length direction of the foam body.

6. The cleaning member of claim 1, wherein the foam body is configured from a urethane foam.

7. A charging device comprising:

a charging member that rotates and charges an outer peripheral face of an image holding body; and the cleaning member of claim 1, wherein the foam body that is wound on and attached to the core in the spiral shape contacts an outer peripheral face of the charging member, the foam body rotating due to rotational force from the charging member, wherein, the radius of the charging member and the radius of the cleaning member are determined such that when the cleaning member rotates due to rotational force from the charging member, the position at which the foam body and the outer peripheral face of the charging member contact changes every rotation.

8. The charging device of claim 7, wherein the radius of the charging member is determined so as not to be an integer multiple of the radial total of the radius of the cleaning member and the thickness of the foam body.

9. A transfer device comprising:

a transfer member that rotates and transfers a toner image onto a transfer receiving member; and the cleaning member of claim 1, wherein the foam body wound on and attached to the core in the spiral shape contacts an outer peripheral face of the transfer member, the foam body rotating due to rotational force from the transfer member.

10. An assembly replaceably mounted to a main body, the assembly comprising:

an image holding body; and the charging device of claim 7 that charges an outer peripheral face of the image holding body.

11. An image forming apparatus comprising:

the assembly of claim 10;

an exposure device that exposes the outer peripheral face of the charged image holding body provided in the assembly and forms an electrostatic latent image; and a developing device that makes the electrostatic latent image formed on the outer peripheral face of the image holding body visible as a toner image.

12. An image forming apparatus comprising:

an image holding body;

a charging device that charges an outer peripheral face of the image holding body;

an exposure device that exposes the outer peripheral face of the image holding body charged by the charging device and forms an electrostatic latent image;

a developing device that makes the electrostatic latent image formed on the outer peripheral face of the image holding body visible as a toner image; and the transfer device of claim 9 that directly, or indirectly, transfers the toner image formed on the outer peripheral face of the image holding body onto a transfer receiving body.

13. A cleaning member comprising:

a rotatably supported core; and a foam body that is disposed in a spiral shape on the core, the foam body having a cross-section orthogonal to a length direction of the foam body, wherein an edge of the cross section that is farthest from the rotatably supported core has a concave shape.

* * * * *